US009310157B2

(12) United States Patent
Jacobs

(10) Patent No.: US 9,310,157 B2
(45) Date of Patent: Apr. 12, 2016

(54) SLING BRACKET DEVICES AND METHODS OF USE WITH ARCHERY BOW

(71) Applicant: Jeeb, Inc., Cable, WI (US)

(72) Inventor: Bobby Jacobs, Cable, WI (US)

(73) Assignee: Jeeb, Inc., Cable, WI (US)

( * ) Notice: Subject to any disclaimer, the term of this patent is extended or adjusted under 35 U.S.C. 154(b) by 0 days.

(21) Appl. No.: 14/821,143

(22) Filed: Aug. 7, 2015

(65) Prior Publication Data

US 2015/0345893 A1 Dec. 3, 2015

Related U.S. Application Data

(63) Continuation of application No. 13/871,322, filed on Apr. 26, 2013, now Pat. No. 9,163,896.

(60) Provisional application No. 61/731,245, filed on Nov. 29, 2012, provisional application No. 61/639,722, filed on Apr. 27, 2012.

(51) Int. Cl.

| | |
|---|---|
| ***F41B 5/14*** | (2006.01) |
| ***F41B 5/00*** | (2006.01) |
| ***F41B 5/20*** | (2006.01) |

(52) U.S. Cl.

CPC ..... *F41B 5/1426* (2013.01); *F41B 5/14* (2013.01); *F41B 5/148* (2013.01); *F41B 5/1461* (2013.01)

(58) Field of Classification Search

CPC ..... F41B 5/14; F41B 5/1426
USPC ..... 124/86, 88, 89
See application file for complete search history.

(56) References Cited

U.S. PATENT DOCUMENTS 3,055,354 A * 9/1962 Gates ..... F41B 5/14 124/23.1
3,204,626 A * 9/1965 Morneau ..... F41B 5/14 124/23.1
3,572,312 A * 3/1971 Foster ..... F41B 5/14 124/23.1
3,812,834 A 5/1974 Saunders
4,714,071 A * 12/1987 Saunders ..... F41B 5/14 124/88
4,777,666 A 10/1988 Beverlin
4,836,177 A * 6/1989 Williams ..... F41B 5/14 124/88
5,065,732 A * 11/1991 Smith ..... F41B 5/1461 124/23.1
5,531,211 A * 7/1996 Wilfong, Jr. ..... F41B 5/14 124/25.6
5,619,981 A * 4/1997 Breedlove ..... F41B 5/1426 124/86
5,894,672 A 4/1999 Ellenburg et al.
6,173,707 B1 * 1/2001 Howell ..... F41B 5/14 124/88
7,954,175 B2 6/2011 Platt
7,954,481 B2 * 6/2011 Barnard ..... F41B 5/1426 124/25.6

(Continued)

*Primary Examiner* — Alexander Niconovich
(74) *Attorney, Agent, or Firm* — Lerner, David, Littenberg, Krumholz & Mentlik, LLP

(57) ABSTRACT

In one embodiment, the present invention is a wrist sling bracket for an archery bow, including a main body having a length between a first end and a second end, and a flat portion between the first and second ends to be positioned on and secured to the bow; a first throughbore and a second throughbore, positioned through the main body, through which a first portion and a second portion of a sling, respectively, can be positioned; a first passageway intersecting the first throughbore and a second passageway intersecting the second throughbore; and a first securing element and a second securing element each including a shaft portion and a handle portion, each shaft portion being positionable through the first and second passageways and within at least a portion of the first and second throughbores, respectively, and each handle portion having a diameter larger than a diameter of the particular passageway.

18 Claims, 7 Drawing Sheets

(56) References Cited

U.S. PATENT DOCUMENTS 8,025,047 B2 9/2011 Saunders
8,347,870 B1 * 1/2013 Mahutga ..... F41B 5/1426 124/89
8,360,044 B2 * 1/2013 Platt ..... A63B 21/4001 124/1
8,646,440 B1 * 2/2014 Albanese ..... F41B 5/1426 124/88
8,662,064 B1 * 3/2014 Campbell ..... F41B 5/1426 124/86
8,695,580 B2 * 4/2014 LoRocco ..... F41B 5/1426 124/89
8,776,772 B1 * 7/2014 Albanese ..... F41B 5/1426 124/86
8,819,983 B2 * 9/2014 Tate ..... F16M 11/041 124/88
8,955,504 B1 * 2/2015 Albanese ..... F41B 5/1426 124/86
2009/0095270 A1 4/2009 Graves
2010/0031946 A1 * 2/2010 LoRocco ..... F41B 5/1426 124/89
2013/0284159 A1 10/2013 Jacobs
2015/0144119 A1 * 5/2015 Arajakis ..... F41B 5/1426 124/88

* cited by examiner

SLING BRACKET DEVICES AND METHODS OF USE WITH ARCHERY BOW

CROSS-REFERENCE TO RELATED APPLICATIONS

The present application is a continuation of U.S. patent application Ser. No. 13/871,322, filed on Apr. 26, 2013, which claims the benefit of the filing date of U.S. Provisional Patent Application Nos. 61/731,245 filed Nov. 29, 2012 and 61/639,722 filed Apr. 27, 2012, the disclosures of which are hereby incorporated herein by reference as if fully set forth herein.

BACKGROUND OF THE INVENTION

Archery, whether grounded in target shooting or hunting, has maintained popularity over the years. Along with this popularity, many features have been developed to improve the use, accuracy and power of an archery bow. One such add-on is the wrist sling (also referred to as an archery sling or simply, a sling) which is positioned over or around the wrist of a user. Typically, the sling is secured to the bow, commonly at a location near the hand grip of the bow to easily accommodate the user's wrist. During use, a wrist sling keeps the bow connected to the user when the user releases the grip of the bow whether intentionally or by accident. For example, the archery community has concluded that merely bracing the grip with your hand, rather than actually gripping the grip, is an integral part of accurate arrow shooting. Of course, by not gripping the bow, the bow will fall out of the user's hand upon release of the tension on the bow string, and thus release of the arrow. As such, the sling keeps the bow connected to the user's arm for simplified and more efficient reloading as well as preventing the bow from falling to the ground—a particular issue when for example the user is positioned up in a tree while hunting.

Further, current slings known in the prior art are affixed to bows using brackets having locking screws, or the like, such that a hunter must carry with him an appropriate tool or instrument to adjust (tighten or loosen) the locking screws to adjust the sling as desired. This is often a problem when the locking screws loosen during use and the hunter must tighten the locking screws during the hunt. This can be particularly troublesome if the hunter forgets to bring the tool along for the hunt.

Another issue faced in archery is vibration or harmonic forces due primarily to the use of the bow (e.g., release of an arrow). Current prior art add-ons include harmonic or vibration dampeners that are attached to the bow and which are intended to reduce such forces. However, such dampeners are cumbersome, add weight to the bow, and increase the difficulty in maneuvering the bow due to the dampener extending from the bow. This, again, is a particular problem when hunting and, for example, positioned within the branches of the tree, such that the dampener could get snagged on a branch while maneuvering the bow.

As such, current add-ons such as wrist slings and associated brackets and vibration dampeners can be difficult to adjust, can be cumbersome, and may interfere with the use of the bow. Thus, there is a need in the art for improved features, such as wrist slings and brackets, that overcome many of these deficiencies.

BRIEF SUMMARY OF THE INVENTION

The present invention, generally relates to a bracket for use with an archery bow for securing a sling to the bow. The bracket can include a vibration dampener for dampening forces exerted on a user during use of the bow and/or a hand-adjustable securing element for securing the sling to the bracket. The bracket of the present invention provides many benefits including but not limited to: providing a compact device which provides multiple functions, providing numerous features and functions which are easy to use, providing a compact device which takes up a minimal amount of space on the bow and also minimizes weight added to the bow, and providing numerous features and functions in a compact device where such features are concealed or disguised to maintain an aesthetically pleasing device.

In one embodiment, the present invention includes a bracket for use with an archery bow, including a main body having a length extending between a first end and a second end, at least one throughbore through which a portion of a sling can be positioned, at least one passageway intersecting the throughbore, and at least one securing element positionable through the passageway and into at least a portion of the throughbore, the securing element adapted to releasably secure the portion of the sling within the throughbore.

Continuing with this embodiment, the securing element can include a threaded portion and the passageway includes a matching thread which can accept the thread of the securing element such that the securing element is hand-adjustable. Further, the throughbore can be positioned transverse to the length of the main body (and optionally, can extend perpendicular to the longitudinal axis) and the passageway may extend from one of the first or second ends of the main body, along a longitudinal axis of the main body, and to the throughbore.

Further, the main body may also include a second throughbore through which a second portion of the sling can be positioned, a second passageway intersecting the throughbore, and a second securing element positionable through the second passageway and into at least a portion of the second throughbore, the second securing element adapted to releasably secure the second portion of the sling within the second throughbore. Additionally, both the first and second securing elements can include a threaded portion and the first and second passageways each includes a matching thread which accepts the thread of the respective first and second securing elements such that the first and second securing elements are hand-adjustable, each of the first and second securing elements includes a handle portion extending from the threaded portion, the first passageway extends from the first end of the main body, along a longitudinal axis of the main body, and to the first throughbore, the first throughbore extends perpendicular to the longitudinal axis, and the handle portion of the first securing element is positioned adjacent the first end of the main body from which the first passageway extends, and the second passageway extends from the second end of the main body, along the longitudinal axis of the main body, and to the second throughbore, the second throughbore extends perpendicular to the longitudinal axis, and the handle portion of the second securing element is positioned adjacent the second end of the main body from which the second passageway extends.

In another embodiment, the present invention is a bracket for use with an archery bow, including a main body having a length extending between a first end and a second end, a first throughbore and a second throughbore through which a first portion and a second portion of a sling, respectively, can be positioned, and at least one vibration dampener. The bracket can also include two or more vibration dampeners, such that the first vibration dampener can be positioned at the first end of the main body and the second vibration dampener can be positioned at the second end of the main body. The main body can also include a longitudinal axis extending along the length and the first and second vibration dampeners can be positioned to dampen forces occurring perpendicular to the longitudinal axis. Further, the first and second vibration dampeners may be positioned substantially within the volume of the main body and at the respective first and second ends.

In yet another embodiment, the present invention includes a bracket for use with an archery bow, including a main body having a length extending between a first end and a second end, at least one throughbore through which a portion of a sling can be positioned, at least one passageway intersecting the throughbore, at least one securing element positionable through the passageway and into at least a portion of the throughbore, the securing element adapted to releasably secure the portion of the sling within the throughbore, and at least one vibration dampener.

Continuing with this embodiment, the securing element can include a threaded portion and the passageway includes a matching thread which can accept the thread of the securing element such that the securing element is hand-adjustable. Further, the throughbore can be positioned transverse to the length of the main body (and optionally, can extend perpendicular to the longitudinal axis) and the passageway may extend from one of the first or second ends of the main body, along a longitudinal axis of the main body, and to the throughbore.

Further, the main body may also include a second throughbore through which a second portion of the sling can be positioned, a second passageway intersecting the throughbore, a second securing element positionable through the second passageway and into at least a portion of the second throughbore, the second securing element adapted to releasably secure the second portion of the sling within the second throughbore, and a second vibration dampener. Additionally, both the first and second securing elements can include a threaded portion and the first and second passageways each includes a matching thread which accepts the thread of the respective first and second securing elements such that the first and second securing elements are hand-adjustable, each of the first and second securing elements includes a handle portion extending from the threaded portion, the first passageway extends from the first end of the main body, along a longitudinal axis of the main body, and to the first throughbore, the first throughbore extends perpendicular to the longitudinal axis, and the handle portion of the first securing element is positioned adjacent the first end of the main body from which the first passageway extends, and the second passageway extends from the second end of the main body, along the longitudinal axis of the main body, and to the second throughbore, the second throughbore extends perpendicular to the longitudinal axis, and the handle portion of the second securing element is positioned adjacent the second end of the main body from which the second passageway extends.

The vibration dampener can be positioned anywhere on the bracket, such as at one of the first or second ends of the bracket. If two vibration dampeners are included, the first vibration dampener can be positioned at the first end of the main body and the second vibration dampener can be positioned at the second end of the main body. In a preferred embodiment, the securing elements include a handle portion, and the first vibration dampener can be positioned within the handle portion of the first securing element and the second vibration dampener can be positioned within the handle portion of the second securing element. The main body can also include a longitudinal axis extending along the length and the first and second vibration dampeners can be positioned to dampen forces occurring perpendicular to the longitudinal axis. For example, the passageway can extend from one of the first or second ends of the main body, along a longitudinal axis of the main body, and to the throughbore, the throughbore can extend perpendicular to the longitudinal axis, and the handle portion may be positioned adjacent the first or second end of the main body from which the passageway extends, such that the vibration dampener (or dampeners) may be positioned substantially within the volume of the handle portion (or portions) of the securing elements such that it is positioned perpendicular to the longitudinal axis.

In a further embodiment, the present invention includes a method of dampening forces exerted on a user of an archery bow, the forces resulting from the release of an arrow from the bow, including the step of connecting a bracket to the bow, the bracket comprising a main body having a length extending between a first end and a second end, a first throughbore and a second throughbore through which a first portion and a second portion of a sling, respectively, can be positioned, and at least one vibration dampener, wherein the main body includes a longitudinal axis extending along the length and the at least one vibration dampener is positioned to dampen forces occurring perpendicular to the longitudinal axis.

In another embodiment, the present invention includes a method of hand-adjusting a sling on an archery bow, including the steps of connecting a bracket to the bow, the bracket comprising a main body having a length extending between a first end and a second end, a first throughbore through which a first portion of the sling can be positioned, a second throughbore through which a second portion of the sling can be positioned, a first securing element in communication with at least a portion of the first throughbore, and a second securing element in communication with at least a portion of the second throughbore; positioning the sling through the first and second throughbores; hand-adjusting the first and second securing elements to releasably secure the first and second portions of the sling within the respective first and second throughbores; using the bow to fire an arrow to determine whether the sling is in a desired position; hand-adjusting the first and second securing elements to release the first and second portions of the sling; re-positioning the sling through the first and second throughbores such that third and fourth portions of the sling are positioned within the respective first and second throughbores; and hand-adjusting the first and second securing elements to releasably secure the third and fourth portions of the sling within the respective first and second throughbores. The method can further include the steps of using the bow a second time to fire a second arrow to determine whether the sling is in a desired position; hand-adjusting the first and second securing elements to release the third and fourth portions of the sling; re-positioning the sling through the first and second throughbores such that fifth and sixth portions of the sling are positioned within the respective first and second throughbores; and hand-adjusting the first and second securing elements to releasably secure the fifth and sixth portions of the sling within the respective first and second throughbores. Further, the first and second securing elements can include first and second handle portions and the steps of hand-adjusting includes rotating the first and second handle portions to rotate the threaded portions of the first and second securing elements relative to the threads of the first and second passageways.

In still another embodiment, the present invention includes a method of hand-adjusting a sling on an archery bow, including the steps of connecting a bracket to the bow, the bracket comprising a main body having a length extending between a first end and a second end, a first throughbore through which a first portion of the sling can be positioned, a second throughbore through which a second portion of the sling can be positioned, a first securing element in communication with at least a portion of the first throughbore, and a second securing element in communication with at least a portion of the second throughbore; positioning the sling through the first and second throughbores; hand-adjusting the first and second securing elements to releasably secure the first and second portions of the sling within the respective first and second throughbores; using the bow to fire an arrow to determine whether the sling is in a desired position; hand-adjusting one of the first and second securing elements to release one of the first and second portions of the sling; re-positioning the sling through one of the first and second throughbores such that a third portion of the sling is positioned within the one of the first and second throughbores; and hand-adjusting the one of the first and second securing elements to releasably secure the third portion of the sling within the one of the first and second throughbores.

In a further embodiment, the present invention includes a kit having at least one bracket and a plurality of slings. The kit may further include a plurality of brackets wherein each bracket can accommodate a particular sling or, alternatively, each bracket can accommodate any of the plurality of slings. The kit can further include a bow.

DETAILED DESCRIPTION

Figure 1:
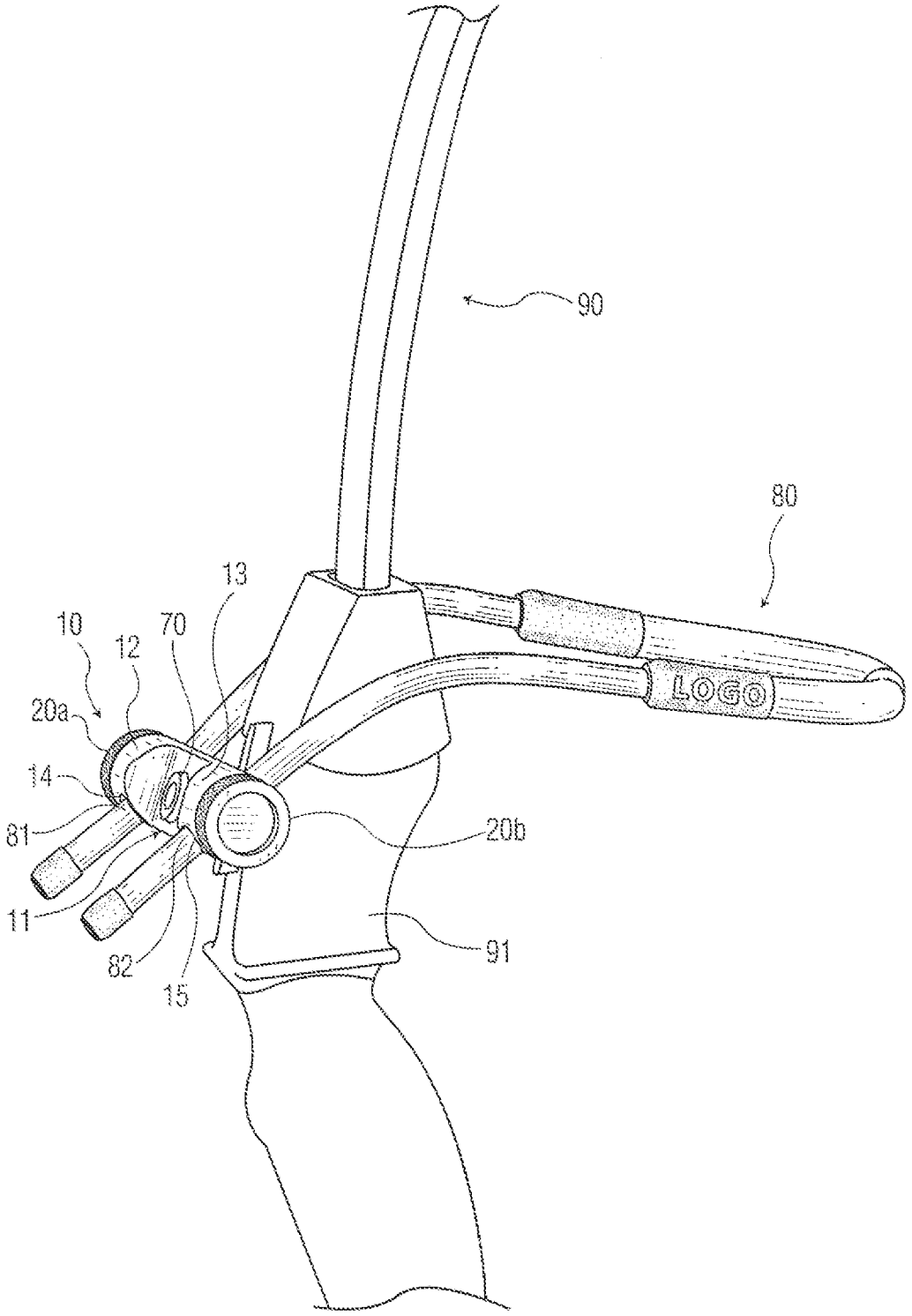
FIG. 1 illustrates one embodiment of a bracket of the present invention positioned on an archery bow.

FIG. 1 illustrates one embodiment of the bracket 10 of the present invention positioned on an archery bow 90. Generally, the bracket 10 connects a wrist sling 80 to the bow 90.

The archery bow 90 may be any style desired, and further the bracket 10 may be secured to the bow at any location desired and in any way as desired. As illustrated, the bracket may be secured to the bow adjacent to or on the grip 91 using a connection element 70 such as for example a screw, threaded bolt (with an associated nut or without, as illustrated), snap fit connection, tie fastener, or the like.

The wrist sling 80 may be any as known in the art which connects the user to the bow upon the user's release of the bow, as discussed above. In one alternative example, and in a preferred embodiment, the sling 80 can be a Stiffy Sling™ (LOC OutdoorZ, Ligonier, Ind.) which is a sling using a braided material that is sufficiently rigid such that it can be shaped and positioned, and remain in such a shape and position, on the bow. For example, prior art slings are flaccid and thus, hang downward or sag on the bow, which can make positioning the user's hand and arm through the sling and to the grip on the bow cumbersome. As illustrated in FIGS. 1-5, the Stiffy Sling™, on the other hand, is a material with sufficient rigidity that, even when the user's hand and arm are not positioned through the sling, it will not sag, thereby allowing for a clear path for the user's hand and arm through the sling and directly to the bow grip.

Figure 8:
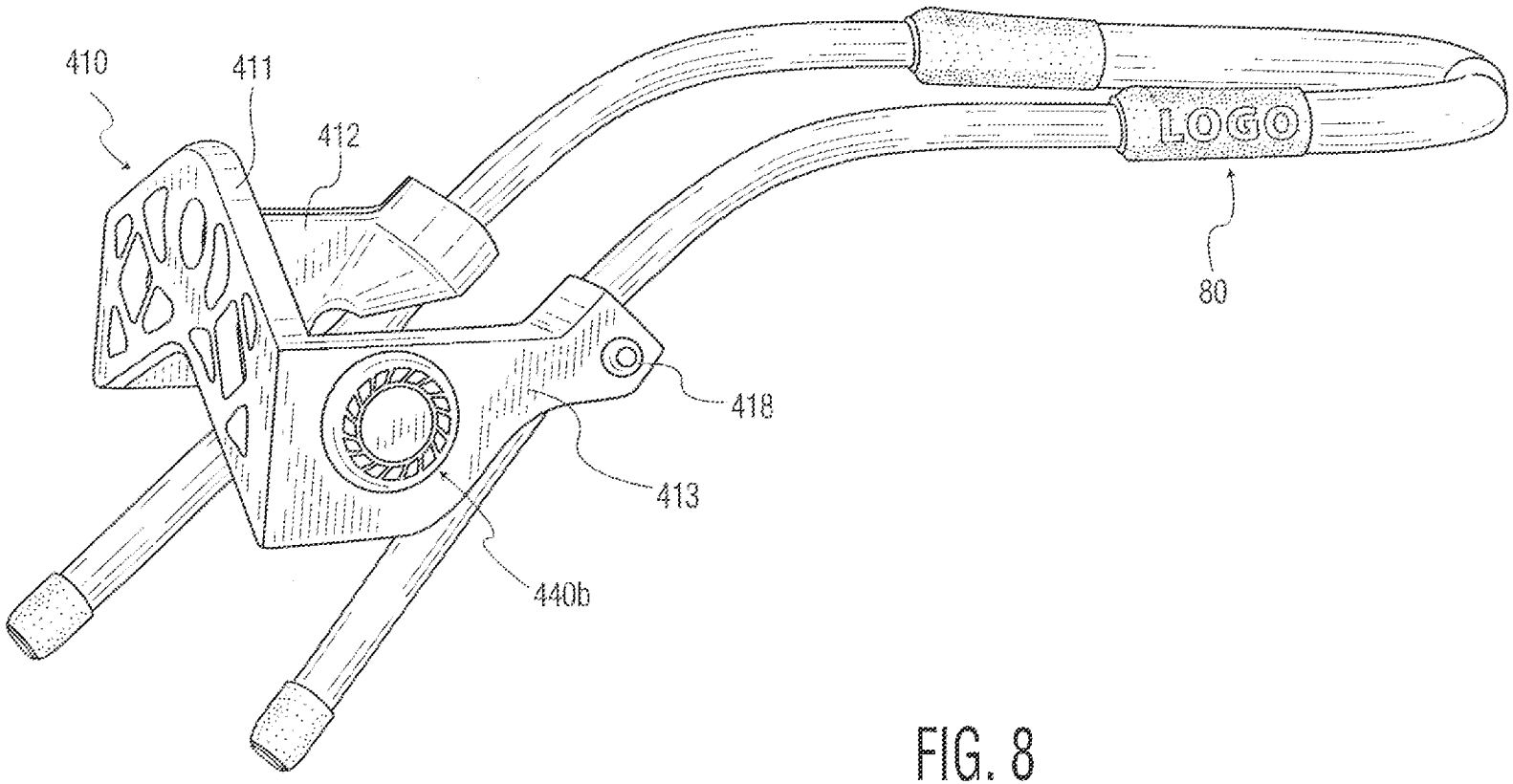
FIG. 8 illustrates a further embodiment of a bracket of the present invention.

The bracket 10, continuing with this embodiment as illustrated in FIG. 1, includes a main body 11 having a length extending between a first end 12 and a second end 13. While the bracket is illustrated as having a generally cylindrical cross-sectional shape, with cutouts positioned along a central portion, the bracket may be of any shape desired. For example, as illustrated in FIG. 8, the bracket 410 may have a generally triangular shape with angled first and second ends 412, 413. Any other shape may also be used, though the cylindrical and triangular shapes have been specifically used as they provide a compact, useful shape for the bracket.

Along the length of the bracket 10 is positioned at least one throughbore 14, though it is preferred that the main body 11 include first and second throughbores 14, 15, positioned on either side of connection element 70 and towards the first and second ends 12, 13, respectively. As illustrated, the throughbores may be positioned through the bracket transverse to a longitudinal axis positioned along the length of the bracket 10. Extending from each of the first and second throughbores 14, 15 to the first and second ends 12, 13, respectively, are first and second passageways (not shown here, but illustrated as passageway 216 in second end 213 in FIGS. 6 and 7) which intersect the respective throughbore and form an opening at the respective first or second end. It is preferred that the passageways are coaxial to the longitudinal axis and the throughbores may be positioned perpendicular to the axis (as both are illustrated throughout the figures), though both of the passageways and throughbores may be positioned at any angle transverse to the axis, and at any angle relative to one another as desired. Also, each passageway may be positioned at a similar angle to the other passageway, or at a different angle, and each throughbore may be positioned at a similar angle to the other throughbore, or at a different angle.

As illustrated, the first throughbore 14 is shaped and sized to allow a first portion 81 of sling 80 to be positioned therethrough and the second throughbore 15 is shaped and sized to allow a second portion 82 of sling 80 to be positioned therethrough. The sling may freely move through the throughbores such that a user can position the sling relative to the bracket as desired.

Figure 6:
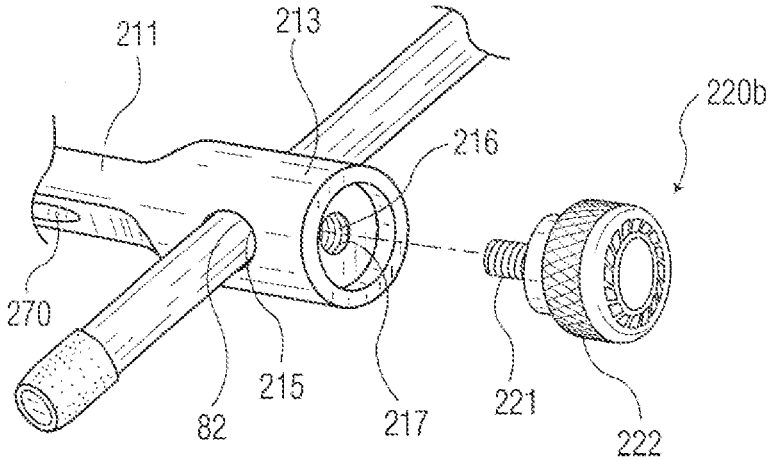
FIG. 6 illustrates another view of a securing element separated from the bracket of FIGS. 3-5 (though this arrangement of the securing element and bracket is also representative of the embodiment of FIG. 1).
Figure 7:
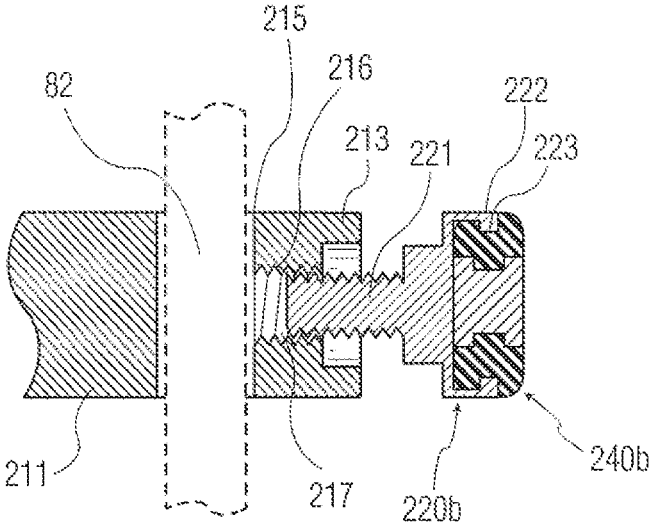
FIG. 7 illustrates a cross-sectional view of the bracket of FIGS. 3-6, with the securing element partially inserted into a passageway of the bracket.

The bracket of this embodiment also includes a first securing element **20*a* and a second securing element 20*b* positioned through the first and second passageways (as illustrated in FIGS. 6 and 7 relative to securing element 220*b* and passageway 216) such that a portion of the securing elements can be positioned within the first and second throughbores at the location where the passageways intersect the throughbores (as represented in FIG. 6 relative to securing element 220*b*, passageway 216 and throughbore 215). For example, as illustrated again in FIG. 6, each securing element 20*a*, 20*b* (220*a*, 220*b*) may include a threaded portion 221 and a handle portion 222, wherein the threaded portion can be positioned through the passageway and a portion of which can pass into the throughbore, and thereby contact a portion of the sling. The passageway may also include a matching thread (in FIGS. 6 and 7, thread 217) which accepts the threaded portion of the securing element. The handle portion may provide an interface between the threaded portion of the securing element and the user, such that the securing element is hand-adjustable. As illustrated, for example, the handle portion may have a circular shape, having a larger diameter than the threaded portion (and preferably, about the same diameter as the main body 11, as illustrated), and may further be textured, to provide the user with sufficient leverage and grip to hand-tighten and hand-loosen the securing element to releasably secure the portion of the sling within the throughbore, as desired. Other shapes and textures for the handle portion are also envisioned. Such an arrangement eliminates the need for a tool or instrument to tighten and loosen structures on the bracket to adjust the sling. With the passageways and throughbores positioned as illustrated, the threaded portions of the securing elements extend from the first and second ends 11, 12 of the bracket and towards and/or into the throughbores (depending on the desired position of the securing elements), and the handle portions are positioned adjacent to the first and second ends. In this configuration, the handle portions are easily accessed by the user and the bracket 10** as a whole maintains a compact, consistent shape.

Figure 2:
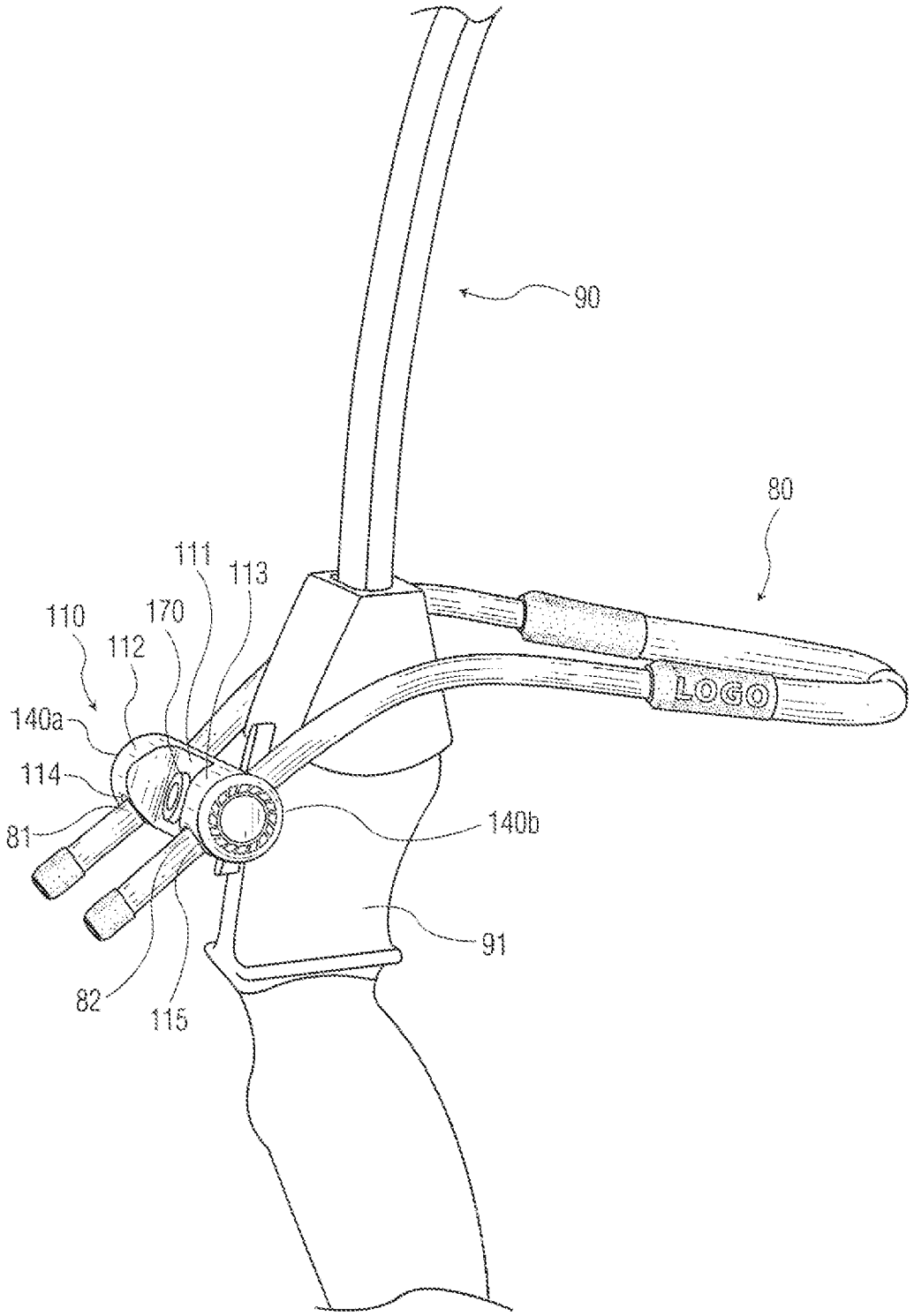
FIG. 2 illustrates another embodiment of a bracket of the present invention positioned on an archery bow.
Figure 3:
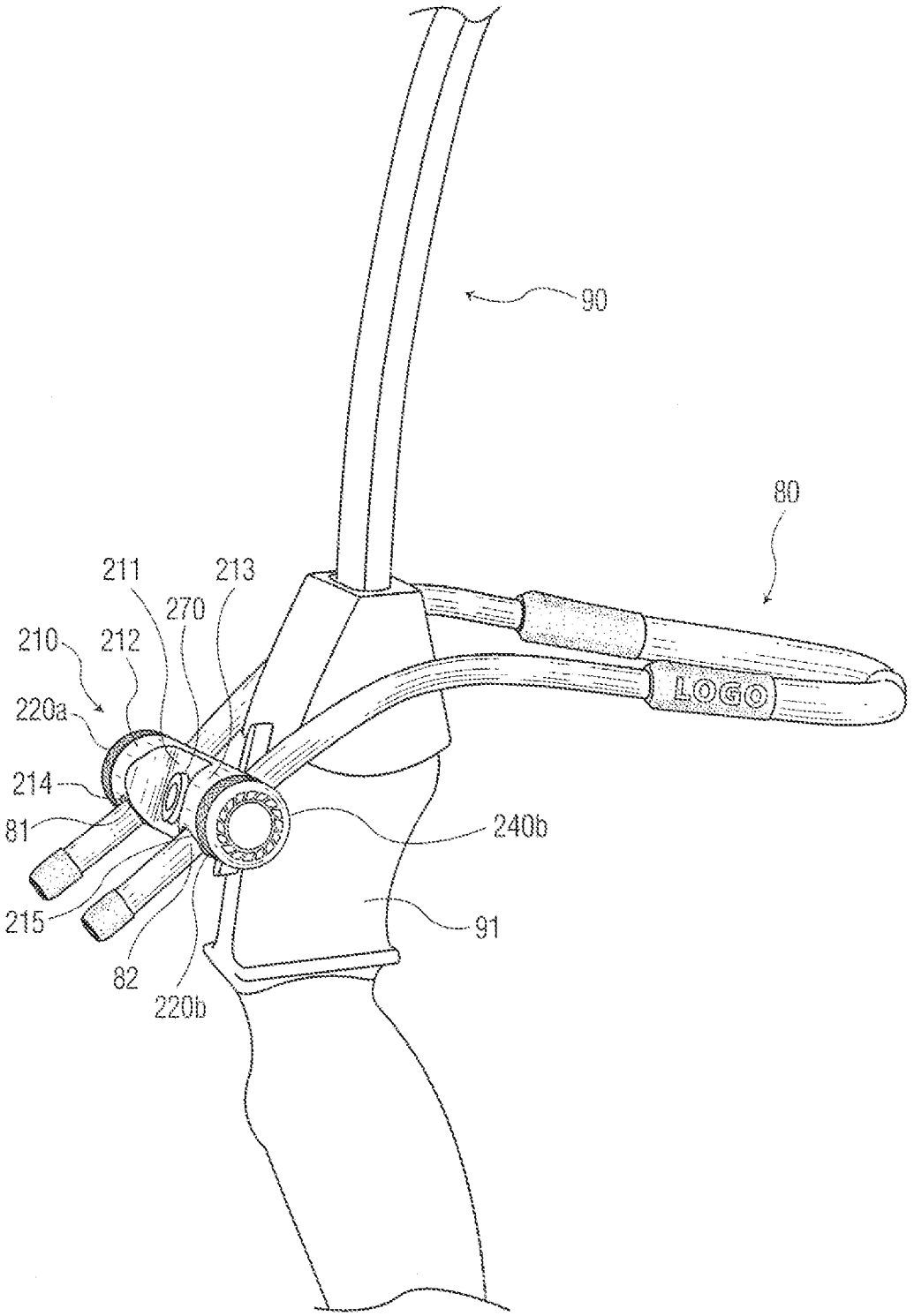
FIG. 3 illustrates yet another embodiment of a bracket of the present invention positioned on an archery bow.
Figure 4:
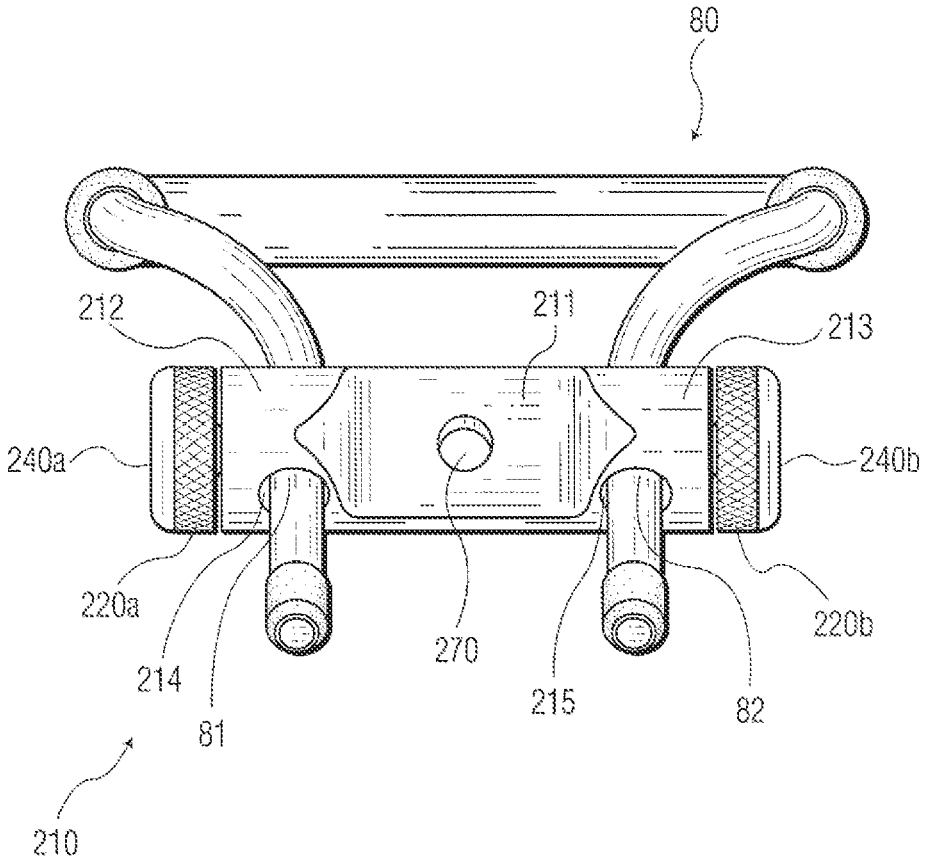
FIGS. 4 and 5 illustrate additional views of the bracket of FIG. 3.
Figure 5:
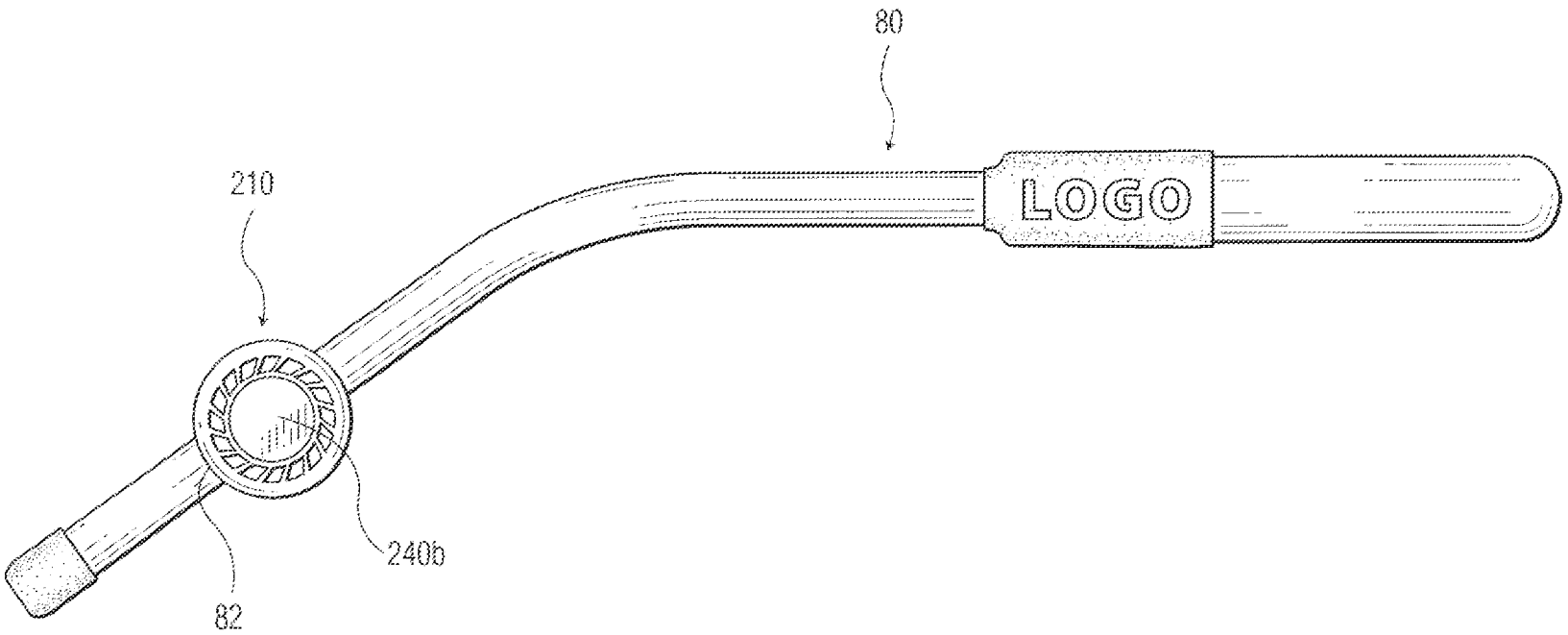

In another embodiment, as illustrated in FIG. 2, the present invention includes a bracket 110 positioned on bow 90 where the bracket connects a wrist sling 80 to the bow 90. The bow and sling may be similar to those described above.

The bracket 110 of this embodiment includes a main body 111 having a length extending between a first end 112 and a second end 113 and is shaped similarly as the embodiment of FIG. 1. As in FIG. 1, bracket 110 includes at least one throughbore 114, and preferably first and second throughbores 114, 115 positioned on either side of connection element 170 and towards the first and second ends 112, 113, respectively. As illustrated, the throughbores may be positioned through the bracket transverse to a longitudinal axis along the length of the bracket 110 and preferably the throughbores are perpendicular to the axis. As above, the first throughbore 114 is shaped and sized to allow a first portion 81 of sling 80 to be positioned therethrough and the second throughbore 115 is shaped and sized to allow a second portion 82 of sling 80 to be positioned therethrough. The sling may freely move through the throughbores such that a user can position the sling relative to the bracket as desired. While this embodiment does not include securing elements (such as 20*a*, 20*b* of FIG. 1, discussed above), the portions of the sling within the throughbores may be secured in any desired fashion. For example, the ends of the sling may be configured into half-hitch knots, either around itself or around a portion of the bracket, to secure the sling. In another example, simple locking screws, clamps, or the like may be used, with an appropriate tool, instrument, or the like, to secure the sling. Other securing structures are also envisioned. If, for example, a simple locking screw is used, the screw may be positioned through a transverse opening (similar to passageway 216 discussed herein) positioned behind an at least one vibration dampener 140 (discussed below), if present. This way, the vibration dampener disguises the hardware (i.e., locking screw), while maintaining both the functionality and aesthetics of the bracket 110. However, in one alternative, as seen in FIG. 8, such a locking screw (illustrated as screw 418) or the like may be easily accessible with a vibration dampener 440*b* positioned away from the locking screw.

Continuing with this embodiment, bracket 110 includes at least one vibration dampener 140. As illustrated, bracket 110 can include two vibration dampeners 140*a*, 140*b*, the first dampener 140*a* positioned at the first end 112 of the main body and the second vibration dampener 140*b* positioned at the second end 113 of the main body. While FIG. 2 illustrates the first and second vibration dampeners positioned substantially within the volume of the main body and at the respective first and second ends, the dampeners may be positioned anywhere within, on or around the main body 110. It is preferred, though, that the dampeners be positioned substantially within the volume of the main body to maintain a compact, aesthetically pleasing, bracket configuration. As illustrated, and in a preferred arrangement, the first and second vibration dampeners can be positioned to dampen forces occurring in any direction relative to the longitudinal axis of the bracket, though the positioning of the dampeners as illustrated allows for particular dampening of forces perpendicular to the longitudinal axis. Such perpendicular forces are generally the largest forces imparted on the bow during use due to the force of tensioning the bow string, releasing the bow string and firing and releasing the arrow.

The vibration dampeners 140*a*, 140*b* may be any type desired which are capable of suppressing vibrational forces associated with the use of the bow. For example, and as illustrated, the dampeners may be Harmonic Dampers® (Mathews, Inc., Sparta, Wis.). By integrating the dampeners 140*a*, 140*b* within the main body 111, bracket 110 provides at least two functions (connection of the sling to the bow and vibrational dampening) within its compact, lightweight size. Further, by positioning the dampeners in a position perpendicular to the axis of the bracket, they can more efficiently and effectively suppress forces associated with use of the bow. It is envisioned that multiple vibration dampeners can be made available to the user such that the user may exchange one dampener for another. Such multiple dampeners may all be the same, or may differ in color, dampening ability, size, or the like, to provide differing functional and/or aesthetic qualities. Of course, if multiple dampeners are available to the user, they may all be the same and may be exchanged in the event of breakage or loss of a dampener, for example.

In yet another embodiment, illustrated in FIGS. 3-7 is a bracket 210 positioned on bow 90 where the bracket connects a wrist sling 80 to the bow 90. The bow and sling may be similar to those described above.

The bracket 210 of this embodiment includes a main body 211 having a length extending between a first end 212 and a second end 213 and is shaped similarly as the embodiments of FIGS. 1 and 2. As in FIGS. 1 and 2, bracket 210 includes at least one throughbore 214, and preferably first and second throughbores 214, 215 positioned on either side of connection element 270 and towards the first and second ends 212, 213, respectively. As illustrated, the throughbores may be positioned through the bracket transverse to a longitudinal axis along the length of the bracket 210. Extending from each of the first and second throughbores 214, 215 to the first and second ends 212, 213, respectively, are first and second passageways 216 (as in FIGS. 6 and 7) which intersect the respective throughbores and extend laterally to form openings at the respective first or second end. It is preferred that the passageways are coaxial to the longitudinal axis and the throughbores may be positioned perpendicular to the axis (as both are illustrated), though both of the passageways and throughbores may be positioned at any angle as discussed above.

As above, the first throughbore 214 is shaped and sized to allow a first portion 81 of sling 80 to be positioned therethrough and the second throughbore 215 is shaped and sized to allow a second portion 82 of sling 80 to be positioned therethrough. The sling may freely move through the throughbores such that a user can position the sling relative to the bracket as desired.

Similar to the embodiment of FIG. 1, bracket 210 includes a first securing element 220*a* and a second securing element 220*b* positioned through the first and second passageways 216 such that a portion of the securing elements can be moveably positioned through the openings of the passageways (at the first and second ends) and within the first and second throughbores at the location where the passageways intersect the throughbores. Securing elements 220*a*, 220*b* may be shaped similar to those of FIG. 1, and may further function and be positioned in a similar manner as discussed above.

Continuing with this embodiment, bracket 210 includes at least one vibration dampener 240, similar to dampeners 140*a*, 140*b* of bracket 110 in FIG. 2. In this embodiment, the at least one dampener 240, or first and second vibration dampeners 240*a*, 240*b*, may be positioned on or within first and second securing elements 220*a*, 220*b*, respectively, and specifically, within the handle portions 222 of the securing elements, as illustrated in FIGS. 3-7. Such positioning of the dampeners maintains bracket 210 in a sleek, compact, aesthetically pleasing design such that it provides numerous benefits and functions for a user and bow 90, while taking up a minimal amount of space and minimizing weight. In fact, positioning the dampeners in this fashion does not expand the size of the bracket 210 by any appreciable degree over and above bracket 10. Moreover, such positioning of dampeners is similar in orientation as discussed above with reference to FIG. 2 and thus bracket 220 also provides benefits associated with this orientation, as discussed above.

For example, FIGS. 6 and 7 illustrate the interaction between the main body 211, securing element 220*b* and dampener 240*b*. As illustrated, the threaded portion 221 of the securing element can matingly engage with matching thread 217 in passageway 216 of main body 211. As such, the securing element can be rotated 220*b* or otherwise maneuvered to move into and through the passageway such that a portion of the threaded portion can pass into the throughbore 215 and engage the portion 82 of the sling 80 positioned therethrough. Further, dampener 240*b* may be positioned within the handle portion 222 of the securing element through a press-fit, snap-fit, or like connection. Further, adhesives and the like may be used to secure the dampener therein. As illustrated, and in a preferred arrangement, the dampener may be removeably secured within the securing element handle portion using a snap-fit connection 223.

The various brackets of the present invention may be included in various systems and kits. In one embodiment, the present invention includes a system including a bracket 10, 110, 210 and a sling 80. Additionally, the system may also include a bow 90. The bracket and optionally, the sling, may be positioned on the bow at manufacture or may be positionable on the bow by the intended user.

In another embodiment, the present invention includes a kit having at least one bracket 10, 110, 210 and a plurality of slings 80. The kit may further include a plurality of brackets wherein each bracket can accommodate a particular sling or, alternatively, each bracket can accommodate any of the plurality of slings. Such a kit can allow a user to select a particular dampener and/or a particular bracket, which provides a desired dampening force, color combination, or the like, based on the available dampeners (as discussed above). The kit may further include a bow which may accommodate any one of the brackets and any one of the slings at a time.

The present invention also includes various methods of using the bracket of the present invention. While below are provided a few exemplary methods of using the bracket, other such methods are also envisioned.

In one embodiment, the present invention includes a method of dampening forces exerted on a user of an archery bow, the forces resulting from the release of an arrow from the bow, including the step of connecting a bracket (for example, either bracket 110 or 210) to the bow 90 using a connection element (170 or 270), the bracket comprising a main body (111, 211) having a length extending between a first end and a second end (112, 113 or 212, 213), a first throughbore and a second throughbore (114, 115 or 214, 215) through which a first portion 81 and a second portion 82 of a sling 80, respectively, can be positioned, and at least one vibration dampener (140 or 240), wherein the main body includes a longitudinal axis extending along the length and the at least one vibration dampener is positioned to dampen forces occurring in any direction relative to the longitudinal axis, and particularly those forces perpendicular to the longitudinal axis.

The bracket may be secured to the bow in any position desired, though a position along the front surface of the bow, adjacent to or at the grip, is preferred. The bracket may further include first and second vibration dampeners (140*a*, 140*b* or 240*a*, 240*b*). The forces dampened by this method, for example, those occurring perpendicular to the longitudinal axis of the bracket, may be those associated with the release of the arrow form the bow, as directed by the user. Of course, the dampeners of this method can dampen other forces occurring in any direction relative to the longitudinal axis.

In another embodiment, the present invention includes a method of hand-adjusting a sling 80 on an archery bow 90, including the steps of connecting a bracket (for example, either bracket 10 or bracket 210) to the bow using a connection element (70 or 270), the bracket comprising a main body (11 or 211) having a length extending between a first end (12 or 212) and a second end (13 or 213), a first throughbore (14 or 214) through which a first portion 81 of the sling can be positioned, a second throughbore (15 or 215) through which a second portion 82 of the sling can be positioned, a first securing element (20*a* or 220*a*) in communication with at least a portion of the first throughbore and a second securing element (20*b* or 220*b*) in communication with at least a portion of the second throughbore; positioning the sling through the first and second throughbores; hand-adjusting the first and second securing elements to releasably secure the first and second portions of the sling within the respective first and second throughbores; using the bow to fire an arrow to determine whether the sling is in a desired position; hand-adjusting the first and second securing elements to release the first and second portions of the sling; re-positioning the sling through the first and second throughbores such that third and fourth portions of the sling are positioned within the respective first and second throughbores; and hand-adjusting the first and second securing elements to releasably secure the third and fourth portions of the sling within the respective first and second throughbores. The third and fourth portions may be adjacent to the first and second portions in that, by re-positioning the sling to have the third and fourth portions positioned within the respective first and second throughbores, the sling is moved in either a forward or backward direction (e.g., forwards or backwards to shrink or lengthen, respectively, the size of the sling).

Furthermore, the bracket may include a first passageway (such as passageway 216 in FIGS. 6 and 7) intersecting the first throughbore, a second passageway (such as passageway 216 in FIGS. 6 and 7) intersecting the second throughbore, the first securing element (20*a* or 220*a*) positionable through the first passageway and into at least a portion of the first throughbore, and the second securing element (20*b* or 220*b*) positionable through the second passageway and into at least a portion of the second throughbore, wherein the first and second securing elements each include a threaded portion (such as threaded portion 221) and the first and second passageways include a matching thread (such as matching thread 217)

which accepts the threaded portion of the first and second securing elements such that the securing elements are hand-adjustable.

Continuing with this embodiment, the method can further include the steps of using the bow a second time to fire a second arrow to determine whether the sling is in a desired position; hand-adjusting the first and second securing elements to release the third and fourth portions of the sling; re-positioning the sling through the first and second throughbores such that fifth and sixth portions of the sling are positioned within the respective first and second throughbores; and hand-adjusting the first and second securing elements to releasably secure the fifth and sixth portions of the sling within the respective first and second throughbores. The fifth and sixth portions may be adjacent to the third and fourth portions (and/or the first and second portions) in that, by re-positioning the sling to have the fifth and sixth portions positioned within the respective first and second throughbores, the sling is moved in either a forward or backward direction (e.g., forwards or backwards to shrink or lengthen, respectively, the size of the sling). This step may be repeated as necessary to attain the proper positioning of the sling relative to the bracket, and thus, the bow.

Additionally, the first and second securing elements can include first and second handle portions and the steps of hand-adjusting includes rotating the first and second handle portions to rotate the threaded portions of the first and second securing elements relative to the threads of the first and second passageways.

In still another embodiment, the present invention includes a method of hand-adjusting a sling 80 on an archery bow 90, including the steps of connecting a bracket (for example, either bracket 10 or bracket 210) to the bow using a connection element (70 or 270), the bracket comprising a main body (11 or 211) having a length extending between a first end (12 or 212) and a second end (13 or 213), a first throughbore (14 or 214) through which a first portion 81 of the sling can be positioned, a second throughbore (15 or 215) through which a second portion 82 of the sling can be positioned, a first securing element (20*a* or 220*a*) in communication with a portion of the first throughbore and a second securing element (20*b* or 220*b*) in communication with a portion of the second throughbore; positioning the sling through the first and second throughbores; hand-adjusting the first and second securing elements to releasably secure the first and second portions of the sling within the respective first and second throughbores; using the bow to fire an arrow to determine whether the sling is in a desired position; hand-adjusting one of the first and second securing elements to release one of the first and second portions of the sling; re-positioning the sling through one of the first and second throughbores such that a third portion of the sling is positioned within the one of the first and second throughbores; and hand-adjusting the one of the first and second securing elements to releasably secure the third portion of the sling within the one of the first and second throughbores. The third portion may be adjacent to either of the first and second portions in that, by re-positioning the sling to have the third portion positioned within the particular first or second throughbore, the sling is moved in either a forward or backward direction (e.g., forwards or backwards to shrink or lengthen, respectively, the size of the sling).

Furthermore, the bracket may include a first passageway (such as passageway 216) intersecting the first throughbore, a second passageway (such as passageway 216) intersecting the second throughbore, the first securing element (20*a* or 220*a*) positionable through the first passageway and into at least a portion of the first throughbore, and the second securing element (20*b* or 220*b*) positionable through the second passageway and into at least a portion of the second throughbore, wherein the first and second securing elements each include a threaded portion 221 and the first and second passageways include a matching thread 217 which accepts the threaded portion of the first and second securing elements such that the securing elements are hand-adjustable.

As with the previously disclosed method, one of the first or second securing elements may be hand-adjusted such that the sling may be re-positioned again such that now a fourth portion is positioned within the particular first or second throughbore. This step may be repeated as necessary to attain the proper positioning of the sling relative to the bracket, and thus, the bow.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A wrist sling bracket for an archery bow, comprising:

a main body having a length between a first end and a second end, and a flat portion between the first and second ends to be positioned on and secured to the bow;

a first throughbore and a second throughbore, positioned through the main body, through which a first portion and a second portion of a sling, respectively, can be positioned;

a first passageway and a second passageway extending into the main body; and a first securing element and a second securing element, each being adjustable to releasably secure the first and second portions of the sling, respectively, each securing element including a shaft portion and a handle portion, each shaft portion being positionable through the first and second passageways, respectively, and each handle portion having a diameter larger than a diameter of the particular passageway.

2. The bracket of claim 1, wherein the first and second securing elements are adjusted via the handle portion to releasably secure the sling portions without the use of a tool.

3. The bracket of claim 1, wherein the first and second throughbores are positioned towards the first and second ends of the main body, respectively.

4. The bracket of claim 1, wherein the flat portion includes a connection element adapted to secure the bracket to the bow.

5. The bracket of claim 1, further comprising at least one vibration dampener.

6. The bracket of claim 1, wherein the flat portion has a height and the handle portions of the first and second securing elements have a diameter substantially equal to the height of the flat portion.

7. The bracket of claim 1, wherein the shaft portion of the securing element is threaded and the passageway includes a matching thread which accepts the threaded shaft portion such that the securing element is hand-adjustable.

8. The bracket of claim 1, wherein the throughbores are positioned transverse to the length of the main body.

9. The bracket of claim 8, wherein the flat portion extends from a top portion of the main body to a bottom portion of the main body, and the throughbores extend from a position closer to the top surface than the bottom surface to a position closer to the bottom surface than the top surface.

10. The bracket of claim 1, wherein the handle portions of the first and second securing elements are positioned past the first and second ends of the main body, respectively.

11. A wrist sling system for an archery bow, comprising:

a wrist sling; and a bracket including:

a main body having a height and extending lengthwise from a connection element adapted to secure the bracket to the bow;

a first throughbore, positioned through the main body, through which a first portion of the sling can be positioned;

a first passageway positioned in the main body; and a first securing element that is adjustable to releasably secure the first portion of the sling, the securing element including a shaft portion and a handle portion, the shaft portion being positionable through the first passageway, and the handle portion having a diameter larger than a diameter of the passageway.

12. The system of claim 11 further comprising a second throughbore, positioned through the main body, through which a second portion of the sling can be positioned, a second passageway positioned in the main body, and a second securing element that is adjustable to releasably secure the second portion of the sling, the securing element including a shaft portion and a handle portion, the shaft portion being positionable through the second passageway, and the handle portion having a diameter larger than a diameter of the second passageway.

13. The system of claim 12, wherein the first throughbore is positioned through the main body to one side of the connection element and the second throughbore is positioned through the main body to the opposite side of the connection element.

14. The system of claim 13, wherein the first and second throughbores are positioned transverse to the length of the main body and wherein the height of the main body extends from a top portion of the main body to a bottom portion of the main body, and the first and second throughbores extend from a position closer to the top surface than the bottom surface to a position closer to the bottom surface than the top surface.

15. The system of claim 12, wherein the first and second securing elements are adjusted via the handle portion to releasably secure the sling portions without the use of a tool.

16. The system of claim 12, wherein the first and second throughbores are positioned towards a first end and a second end of the main body, respectively.

17. The system of claim 12, wherein the handle portions of the first and second securing elements have a diameter substantially equal to the height of the main body.

18. The system of claim 12, wherein the shaft portion of the securing element is threaded and the passageway includes a matching thread which accepts the threaded shaft portion such that the securing element is hand-adjustable.

* * * * *